United States Patent [19]

Längerich et al.

[11] Patent Number: 4,472,209

[45] Date of Patent: Sep. 18, 1984

[54] CARBURIZING METHOD

[75] Inventors: Karlheinz Längerich, Marktoberdorf; Wolfgang Danzer; Rüdiger Conrad, both of Munich, all of Fed. Rep. of Germany

[73] Assignees: Linde Aktiengesellschaft, Wiesbaden; Xaver Fendt & Co., Marktoberdorf, both of Fed. Rep. of Germany

[21] Appl. No.: 309,477

[22] Filed: Oct. 7, 1981

[30] Foreign Application Priority Data

Oct. 8, 1980 [DE] Fed. Rep. of Germany ..... 3038078

[51] Int. Cl.[3] ..... C21D 1/00

[52] U.S. Cl. ..... 148/13; 148/16.5; 148/16.6

[58] Field of Search ..... 148/16.5, 16.6, 13.0

[56] References Cited

U.S. PATENT DOCUMENTS

| | | | |
|---|---|---|---|
| Re. 29,881 | 1/1979 | Westeren et al. | 148/16.5 |
| 2,886,478 | 5/1959 | Beard | 148/16.5 |
| 4,035,203 | 7/1977 | L'Hermite et al. | 148/16.6 |
| 4,049,473 | 9/1977 | Davis et al. | 148/16.5 |
| 4,152,177 | 5/1979 | Mantel et al. | 148/16.5 |
| 4,168,186 | 9/1979 | Limque et al. | 148/16.5 |

FOREIGN PATENT DOCUMENTS

| | | |
|---|---|---|
| 2450879 | 4/1975 | Fed. Rep. of Germany . |
| 2818558 | 11/1978 | Fed. Rep. of Germany . |
| 527081 | 10/1940 | United Kingdom . |

*Primary Examiner*—John P. Sheehan

*Attorney, Agent, or Firm*—Karl F. Ross; Herbert Dubno

[57] ABSTRACT

A method of carburizing a metal workpiece and a carburizing apparatus in which the workpiece, generally of steel, is introduced into an annealing oven and subjected to a high temperature in the presence of a carbon-containing gas mixture as a result of which the workpiece is hardened. According to the invention, one or more of the carbon-containing gas components of the mixture effective upon the surface of the work-piece, can be periodically and impulsively injected into the gas mixture for sudden increases in carbon potential followed by longer diffusion phase.

4 Claims, 6 Drawing Figures

CARBURIZING METHOD

CROSS REFERENCE TO RELATED APPLICATION

This application is related to the concurrently filed commonly owned application Ser. No. 309,476, abandoned.

FIELD OF THE INVENTION

Our present invention relates to a method of carburizing metallic workpieces, especially steel workpieces and, more particularly, a method which improves upon conventional gas carburization and hardening of such workpieces. The invention also relates to a method of operating an annealing furnace to effect improved gas carburization therein.

BACKGROUND OF THE INVENTION

While numerous case-hardening processes have been developed over the years for obtaining an increased level of carbon in surface regions of metallic workpieces, especially steel workpieces, increasing interest has centered, in recent years, upon gas carburization and gas carbonitriding, processes in which the steel workpieces are brought to an elevated temperature generally in excess of 900° C. and contacted with a gas mixture which can include a carbon-containing compound and, if desired, a nitrogen-containing compound. With carbonitriding, nitrogen from ammonia, for example, can diffuse into surface regions of the workpiece together with carbon to increase the carbon level and, if desired, the nitrogen level.

The workpiece can form part of a charge introduced into an annealing oven or furnace which is provided with the controlled atmosphere and is brought to the desired reaction temperature, both the atmosphere and the temperature being maintained during the course of the heat treatment.

It has been found to be difficult with gas carburization processes developed to date to obtain reproducible carburization results with variations in the metal alloys which may be provided as the workpieces, differences in contours thereof and differences in the interaction of the workpieces with the gas. As a result, if all other parameters of operation of the annealing furnace are held constant and only the charge is changed, one finds differences in the carbon penetration among workpieces of the charge as well as differences in such penetration between successive charges although the operating conditions were ostensibly identical. It has already been proposed to form the carburization atmosphere from a three-component gas mixture including a carbon carrier, a nitrogen carrier, a hydrogen carrier and an oxygen donor. Thus, for example, ammonia can form the hydrogen and nitrogen carrier, a hydrocarbon can form the carbon and hydrogen carriers, etc. An oxygen donor can also be provided (see German patent documents DE-OS No. 24 50 879 and DE-OS No. 28 18 558).

The carbon carriers suggested are hydrocarbons and preferably the paraffin or paraffinic hydrocarbons, methane, ethane, propane, butane or natural gas with about 57.5 to 38 gram-atoms of carbon.

Suitable oxygen donors include oxygen, air, carbon dioxide, carbon monoxide and steam or mixtures thereof.

The gas components were introduced separately or premixed before being fed to the heat treatment chamber and the measurement and control of the gas atmosphere was effected by dewpoint, measurements, infrared detection of carbon dioxide or oxygen level measurements in the furnace atmosphere.

It has also been suggested to feed methane as a carbon-containing gas to the atmosphere in stages separated by two or three pauses, i.e. phases in which no carbon carrier is introduced.

During the carburization intervals, the carbon potential of the oven atmosphere is sharply raised and soot or carbon black precipitation can occur upon the workpiece. In the next phase, when no carbon carrier is introduced, this precipitated elemental carbon can participate in case hardening. During these pauses in the introduction of the carbon carrier, air is introduced into the chamber and the carbon potential is reduced to zero.

This method has been found to result in edge oxidation zones which are unavoidable. However, without introduction of the oxygen and the consequent elimination of excess precipitated carbon, the process is inefficient and, if one avoids precipitation of carbon, the carburization time is inordinately prolonged.

OBJECTS OF THE INVENTION

It is the principal object of the present invention to provide an improved method of carburizing metal workpieces, especially steel workpieces, whereby the disadvantages of earlier methods are avoided and a uniform reproducible rapid and economical hardening of the workpieces can be achieved.

Another object of this invention is to provide an improved method of operating an annealing furnace for the latter purpose.

SUMMARY OF THE INVENTION

These objects and others which will become apparent hereinafter are attained, in accordance with the present invention, in a method of carburizing metal workpieces in an annealing oven at a carburizing temperature in a carburizing atmosphere to which at least one (i.e. one or more) carbon-containing gas component is injected pulsingly into the heat treatment chamber while this atmosphere is effective to bring about carburization of the surface of the workpiece.

The invention is based upon our discovery that it is possible to sharply increase the rate of carburization and thus the depth of penetration for a given carburization period and/or reduce the heat treatment time for a given degree of carburization when pulsed concentration increases of the carbon-containing gas is effected periodically over the duration of the desired treatment.

Moreover, we have found that with the pulsing of the feed of carbon-containing gas to the gas atmosphere, a large potential gradient can be developed between the workpiece surface and the interior portions of the workpiece to contribute a driving force for the diffusion of carbon into and within the surface regions of the body when the carbon-containing gas is supplied in pulses.

This contribution of carbon-potential gradient can apply from the very inception of the carburization process and is readily superimposed upon the driving force generated by the thermal action and other forces which collectively can be treated as diffusion forces.

Furthermore, since the potential gradient depends to a certain extent on the concentration of the carbon-containing gas, the impulsive supply thereof to the chamber results in a periodic, sharp increase in this concentration which cannot be obtained when, at the mean concentration, the gas is admitted continuously.

The concentration can fall after these impulsive increases without significant effect and, while we are not certain as to the reasons for this phenomenon, we believe there are several factors which may be involved.

For example, the sudden increase in the concentration of carbon-containing gas at the workpiece surface during impulsive supply thereof may result in a high rate of transfer into the immediately adjoining region of the metal structure to temporarily increase the carbon level within the structure at this point so that even during a subsequent decrease in the carbon potential in the interval between pulses, the high internal concentration contributes a driving force of the type discussed above contributed by the gradient.

A second factor that may be considered is the rapid movement of the gas at the surface which may be caused by the impulsive addition of the carbon-containing gas to the point where gas of higher concentration more readily reaches the workpiece surface.

Whatever the reason, the gas mixture which is at least at atmospheric pressure, is periodically and impulsively brought to a higher pressure in a shockwave-type of impulse and this increase in pressure is accompanied by an increase in carbon concentration or carbon potential.

This pressure increase can be augmented when the carburizing gas is a gas capable of cracking under the carburization conditions into two or more moles of fragments, e.g. radicals, per mole of hydrocarbon. Best results are obtained with hydrocarbons having two or more carbon atoms. The pressure in the chamber thus fluctuates with the same rhythm as the impulsive supply of the carbon-containing component and a breathing type of action is thus found in the atmosphere within the annealing oven.

The results which are obtained with the present invention are indeed surprising. For example, the annealing time can be reduced up to 60% by comparison with the annealing time in the endogas process, the annealing time, of course, being the time required for carburization and diffusion.

In addition, the depths of hardening and carburization are increased and further the carburization process is found to be more uniform since the process does not result either in edge oxidation or the deposit of carbon black upon the workpiece. The process is also significantly more reliable because it utilizes or involves hydrocarbons so that the danger of explosion is reduced and the oven can be vented when it is not required for operation, e.g. on weekends, with no difficulty. Furthermore, special gas generators are not required.

According to another feature of the invention, the one or more hydrocarbons which are impulsively supplied to the chamber are fed during injection periods which are comparatively short with reference to the diffusion-phase pause between successive injections.

We have found that the injection periods can range from two to two hundred seconds (preferably 15 to 60 sec.) each while the intervening periods, i.e. the diffusion phase between successive injections should occupy 10 to 500 seconds, being preferably 50 to 200 seconds.

We have found that it is possible to measure the methane and/or soot content of the gas mixture of the atmosphere in the oven and to generate an actual value signal which is delivered to a control unit which compares this value with the setpoint value to adjust the feed of one or more of the hydrocarbons to the setpoint value.

The setpoint value is chosen, in accordance with another feature of the invention, that carbon black or soot formation cannot occur. The surface of the metallic workpieces remain free at all times from carbon deposits and the mean carbon potential is thus held substantially constant although the actual carbon potential will of course fluctuate to either side of the mean.

The carbon potential rises during the pulsed feed of the hydrocarbon briefly and is reduced more slowly during the subsequent diffusion phase below the substantially constant mean or average value. In the system of the invention this carbon potential is not permitted to sink too low.

It is possible, therefore, to operate with carbon potentials which lie above the class limits for the carbon potentials which have been associated with carbon deposition without deposition of carbon black because the durations of these higher carbon potentials are present to assist in driving the carburization process in the direction of rapid diffusion into the workpiece.

The system of the present invention has also been found to be effective for carbonitriding of the steel workpieces and for this purpose ammonia can be pulsed into the chamber.

The method of the invention is carried out in an annealing oven of conventional design. Such furnaces are provided with means for feeding gases to and discharging them from the furnace. The control device which can be provided in accordance with this invention advantageously includes a sensor for carbon black and a gas analyzer for determining the methane content in the gas mixture, the control being effective as a function of error signals which are developed by comparing the actual values obtained with setpoint signals for carbon black and methane, the error signals control a valve feeding the hydrocarbon to the annealing furnace.

According to the invention, the device for feeding the carbon-containing gas component to the chamber opens into the latter at a lower portion thereof and as close as possible to the workpiece to be carburized in the chamber.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
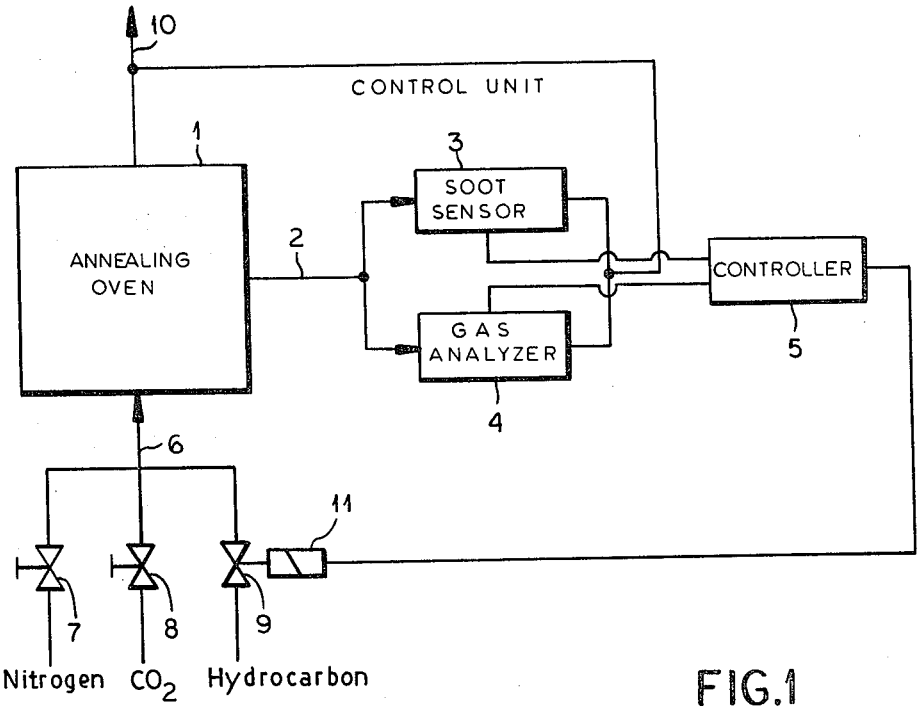
FIG. 1 is a block diagram illustrating an apparatus in accordance with the invention.

FIG. 1 shows an annealing oven 1 which is connected by line 2 with a control unit including a soot or carbon black sensor 3 being connected to a controller in a feedback path represented at 5 for regulating concentration of the carbon carrier within the oven.

According to the invention, valves 7, 8 and 9 are provided respectively for introduction of nitrogen, carbon dioxide and hydrocarbon via line 6 into the oven, the valve 9 being provided with an operator 11 responsive to the controller 5.

During the introductiion of the charge and the initial heating of the charge in the oven, valve 7, which supplies nitrogen, is opened while valves 8 and 9 for the carbon dioxide and the hydrocarbon (preferably propane) are closed.

When the charge in the annealing oven has been brought to a temperature of 800° C. to 1000° C., depending upon the alloy content of the workpiece and the desired hardness penetration, carburization of the charge is begun.

Valves 7 and 8 are open to provide the desired levels of nitrogen and carbon dioxide and valve 9 is open periodically, preferably for periods of 20 seconds, to establish the desired propane concentration for each concentration-increasing hydrocarbon-feed pulse.

Propane is unstable at high temperatures prevailing in the annealing oven and decomposes into highly reactive radicals and, fragments which rapidly saturate or supersaturate the surface region of the workpieces with carbon establishing a sharp increase of the carbon potential gradient between the workpiece surface and the core for the periods of hydrocarbon concentration increase.

Thus, the standard high temperature diffusion force is supplemented by the driving force of the potential gradient and more rapid diffusion inwardly is observed than is the case with a carbon potential which remains constant during the entire carburization process.

Because of the supersaturation with carbon at the workpiece surface, methane and traces of carbon black can be found in the gas mixture.

A portion of the gas mixture is withdrawn via line 2 and the carbon black content determined in sensor 3 while the methane content is determined in analyzer 4 which can be an infrared analyzer.

In the controller 5, these actual values are compared with setpoint values and, should the actual values exceed the setpoint values valve 9 is held closed by the operator 11, i.e. the feed of propane is interrupted. Normally the propane is fed for periods for 20 seconds and the flow is interrupted for periods of about 60 seconds in a cyclical manner.

During this 60-second period of interruption with each cycle, referred to herein as the diffusion phase, the supersaturation of the workpiece surface continually decays as the carbon diffuses toward the heart or core of the workpiece.

Simultaneously, any iron carbide formed at the surface zone because of the high carbon supersaturation, is resolubilized in the structure. Small amounts of amorphous soot react with carbon dioxide to form carbon monoxide. During the diffusion period, the methane and soot contents in the gas mixture drop and when predetermined minimum values are reached, the controller 5 can trigger the operator 11 to reopen valve 9 and begin a new cycle.

After a predetermined carburization time, equivalent to the attainment of a predetermined hardness penetration, valves 8 and 9 are closed and the charge temperature is dropped to a hardening temperature.

Figure 2:
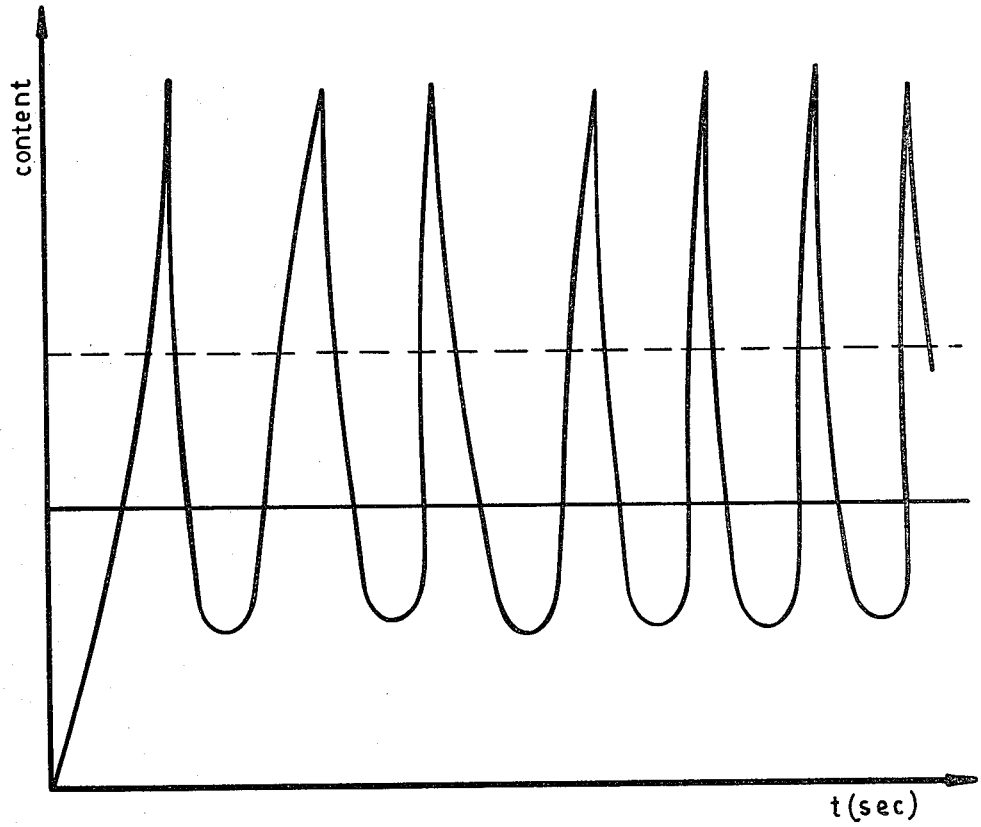
FIG. 2 is a graph in which carbon content of the oven gases is plotted along the ordinate versus time in seconds along the abscissa.

FIG. 2 is a plot of the carbon content of the gas mixture in volume percent versus time in seconds, the broken line representing a dynamic equilibrium while the classical soot definition limit is represented by the horizontal solid line and corresponds to the thermodynamic equilibrium.

It will be apparent, therefore, that by briefly raising the carbon concentration significantly above the thermodynamic equilibrium and then letting the concentration drop during the interim diffusion periods to slightly below the thermodynamic equilibrium it is possible to raise the equilibrium level of carbon at which the method is actually carried out without excessive soot deposition and with more rapid diffusion of carbon into the workpiece.

Figure 3:
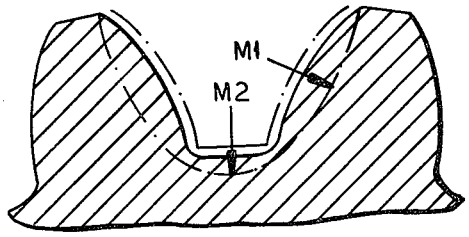
FIG. 3 is a cross sectional view through a portion of a gear serving as a workpiece in the method of the invention and assisting in the explanation of the example.

FIG. 3 shows a section of the teeth of a pinion gear serving as part of the charge of the following examples, the gear being composed of 20 $MnCr_5$, module 5 steel. The greatest penetration (hardness depth is the region M1 along the flank of the tooth or the region M2 at the center of the root.

EXAMPLE 1

A production charge with a total surface area of about 11 $m^2$ and a weight of about 500 kg was carburized at an annealing temperature of 945° C. in an Aichelin multipurpose oven for 130 min. using propane as the carburizing gas. Propane was fed for periods of 20 sec. with intervals (diffusion phases) between the feed periods of about 60 sec.

Figure 4:
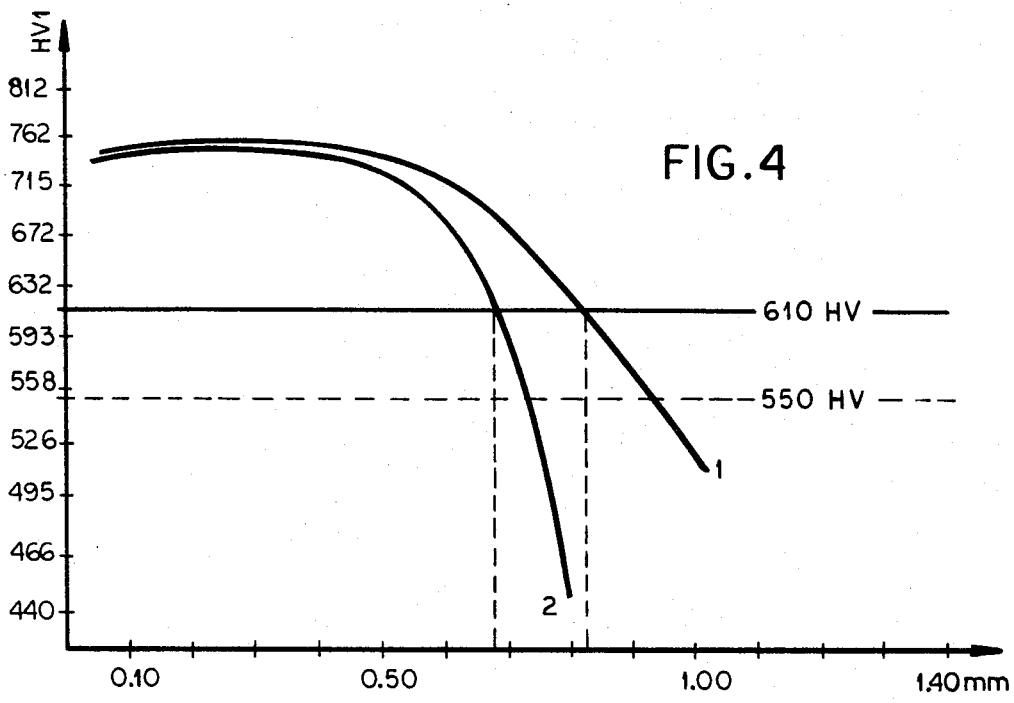
FIGS. 4 and 5 are graphs in which Vickers hardness is ploted along the ordinate versus depth of penetration along the abscissa.

FIG. 4 shows the hardness plotted along the ordinate versus depth plotted along the abscissa for pinions composed of 16 mm $Cr_5$ steel. The Vickers hardness according to German Industrial Standard DIN 6773. Curve 1 corresponds to the measurements at the location M1 of FIG. 3 while curve 2 represents the values at location M2.

The workpiece is free from carbides or residual austenite and the carburized steel has a martensite structure.

From FIG. 4 it will be apparent that the hardness is constant until about 0.45 mm of depth and then falls with increasing depth, the drop at the flanks being slower than the drop at the roots of the gear. A predetermined surface hardness of 610 HV corresponds to a depth at M1 of 0.83 mm and at the root M2 of 0.68 mm, thereby demonstrating that even the flanks of the gears can be effectively hardened.

EXAMPLE 2

Figure 5:
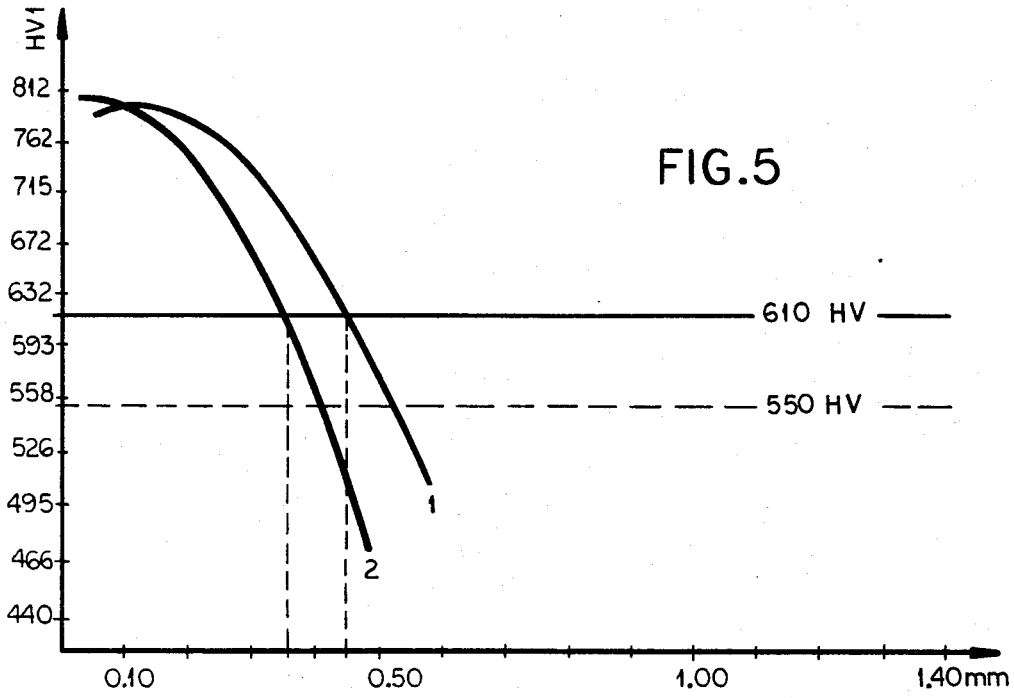

This example was analogous to that of Example 1 except that the annealing temperature was 960° C., the annealing time 30 minutes, the propane feed intervals were 90 sec. long and the diffusion periods 200 sec. long. The results are shown in FIG. 5 and it will be apparent that for a surface hardness of 610 HV, a depth of 0.45 mm at M1 and 0.36 mm at M2 can be attained. Thus even with the short time of 30 min., a significant hardness depths can be reached.

Figure 6:
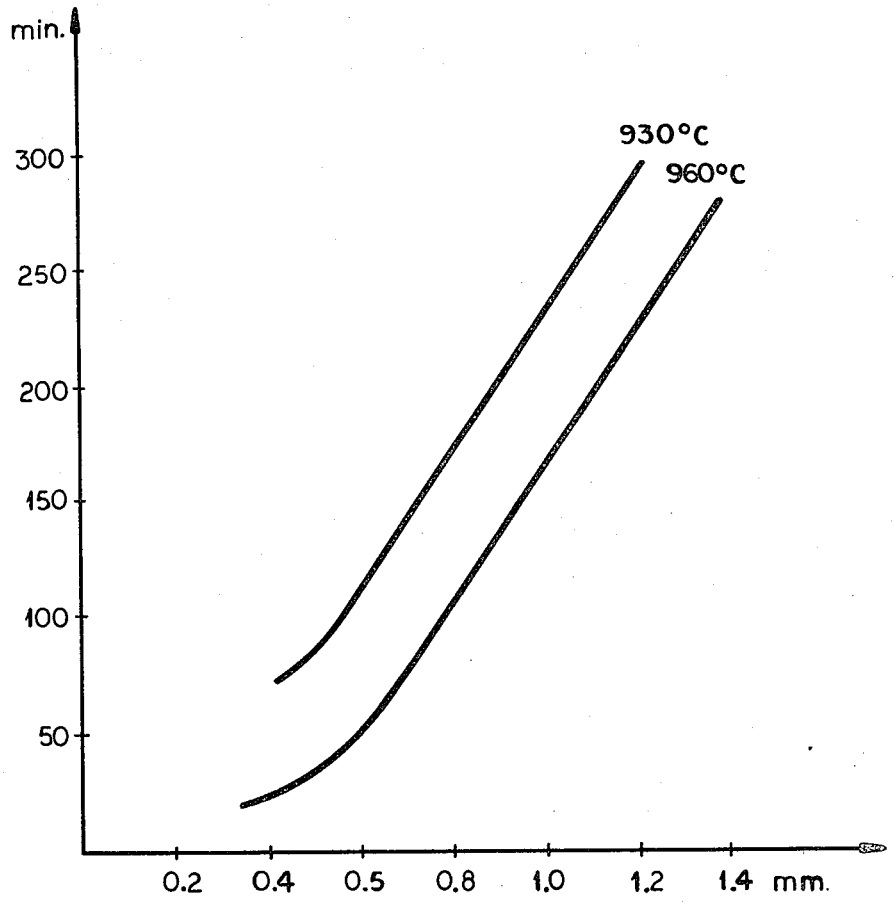
FIG. 6 is another explanatory graph in which the duration of treatment is plotted along the ordinate against Vickers hardness plotted along the abscissa.

FIG. 6 shows the relationship of hardness depths (abscissa) with treatment time at two treatment temperatures, to a hardness of 610 HV1. The curve becomes practically linear above 0.45 mm and the curves for annealing temperatures between 930° C. and 960° C. lie between the two curves shown.

Sixty production tests were used to derive these results.

We claim:

1. A method of case hardening metal workpieces, comprises the steps of:

heating said workpieces to a carburizing temperature in a carburizing gas atmosphere containing nitrogen gas and at a pressure of at least atmospheric pressure for a period sufficient to cause carbon diffusion into surface regions of said workpiece;

continuously introducing at a valve-controlled rate, nitrogen gas directly into said atmosphere; and pulsing a carbon-containing gas into said atmosphere for admixture with said nitrogen gas to increase the carbon-containing gas concentration in a multiplicity of brief pulses followed by respective longer interruptions of introduction enabling diffusion of carbon from surface regions of workpieces toward the core thereof, said carbon-containing gas including at least one hydrocarbon and the intervals of introduction of said hydrocarbon into said atmosphere being small by comparison with the intervals between introduction of said hydrocarbon, with said hydrocarbon being introduced into said atmosphere within periods of 2 to 200 sec. interrupted by periods of 10 to 500 sec.

2. The method defined in claim 1 wherein said hydrocarbon is introduced into said atmosphere for periods of 15 to 60 sec. interrupted by periods of 50 to 200 sec.

3. The method defined in claim 1, further comprising the step of continuously measuring methane and soot content of said atmosphere and controlling the introduction and interruption of the introduction of the hydrocarbon in accordance with deviations of measured values from respective setpoint values.

4. The method defined in claim 1, further comprising the step of introducing ammonia into said atmosphere in a pulsed manner.

* * * * *